US006536615B2

(12) United States Patent
Nishikino et al.

(10) Patent No.: US 6,536,615 B2
(45) Date of Patent: Mar. 25, 2003

(54) LOAD MOMENT INDICATOR OF CRANE

(75) Inventors: Tadakazu Nishikino, Akashi (JP); Hideaki Ishihara, Akashi (JP); Kazuhiro Kobayashi, Takasago (JP); Yoshiki Kamon, Takasago (JP)

(73) Assignee: Kobelco Construction Machinery Co., Ltd., Hiroshima (JP)

( * ) Notice: Subject to any disclaimer, the term of this patent is extended or adjusted under 35 U.S.C. 154(b) by 48 days.

(21) Appl. No.: 09/816,477

(22) Filed: Mar. 26, 2001

(65) Prior Publication Data

US 2001/0032826 A1 Oct. 25, 2001

(30) Foreign Application Priority Data

Mar. 27, 2000 (JP) ..... 2000-086289
Jul. 10, 2000 (JP) ..... 2000-208143

(51) Int. Cl.[7] ..... B66C 23/90
(52) U.S. Cl. ..... 212/278; 212/168
(58) Field of Search ..... 212/278, 270, 212/168

(56) References Cited

U.S. PATENT DOCUMENTS 3,819,922 A * 6/1974 Horn et al. ..... 235/193
3,870,160 A * 3/1975 Hutchings ..... 212/39 R
3,913,081 A * 10/1975 Hamilton ..... 340/267 C
4,187,681 A * 2/1980 Johnson ..... 60/395
4,251,059 A * 2/1981 Fougea ..... 254/338
5,160,055 A * 11/1992 Gray ..... 212/150
5,711,440 A * 1/1998 Wada ..... 212/278

FOREIGN PATENT DOCUMENTS

JP 11-246178 9/1999

* cited by examiner

*Primary Examiner*—Thomas J. Brahan
(74) *Attorney, Agent, or Firm*—Oblon, Spivak, McClelland, Maier & Neustadt, P.C.

(57) ABSTRACT

An load moment indicator, in a crane provided with hoist means of a main side and an auxiliary side, including a calculator in which a reference value if a rated load determined by the stability of a crane or the like is preset, a hoist load of the other side is converted into a load component of its own side, and the converted value is subtracted from a reference value of its own side to thereby obtain a rated load of own side, or in which a tolerant load that can be suspended by the other side is converted into a load component of its own side on the basis of a base of a reference value of the other side, and the converted value is compared with the reference value of its own side to select a lower value. Thereby, it is possible to make the most of the suspending ability of the main side and the auxiliary side and for an operator to grasp clearly a tolerance of the hoist load.

9 Claims, 9 Drawing Sheets

FIG. 3C

16

| BOOM ANGLE | JIB ANGLE | POINT HEIGHT |
|---|---|---|
| 72.4° | 72.4° | 42.0m |

| | MAIN HOIST | AUXILIARY HOIST |
|---|---|---|
| LOAD FACTOR | 13% | 151% |
| ACTUAL LOAD | 35.8t | 129t |
| RATED LOAD | 270t | 85.0t |
| WORKING RADIUS | 42.0m | 68.2m |

LOAD FACTOR EXCEEDS 100%

STANDARD BOOM BOOM LENGTH: 30m
JIB LENGTH: 24m AUX. SHEAVE: NO
MAIN HOOK: 300t AUX. HOOK: 85t
ADD WEIGHT: YES

PM 9:23

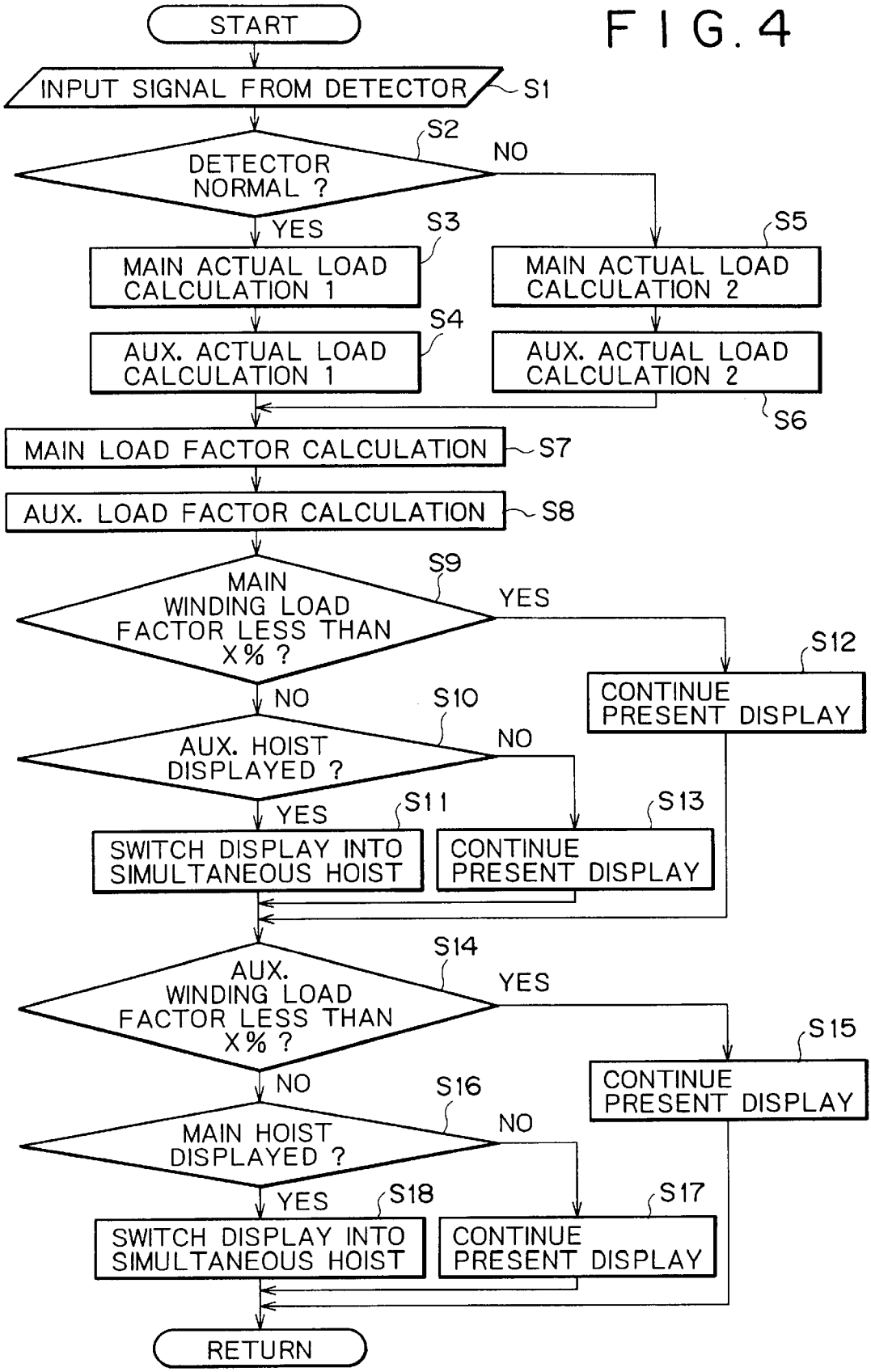
FIG. 4
START
INPUT SIGNAL FROM DETECTOR
S1
DETECTOR NORMAL ?
S2
NO
YES
MAIN ACTUAL LOAD CALCULATION 1
S3
MAIN ACTUAL LOAD CALCULATION 2
S5
AUX. ACTUAL LOAD CALCULATION 1
S4
AUX. ACTUAL LOAD CALCULATION 2
S6
MAIN LOAD FACTOR CALCULATION
S7
AUX. LOAD FACTOR CALCULATION
S8
MAIN WINDING LOAD FACTOR LESS THAN X% ?
S9
YES
CONTINUE PRESENT DISPLAY
S12
NO
AUX. HOIST DISPLAYED ?
S10
NO
YES
SWITCH DISPLAY INTO SIMULTANEOUS HOIST
S11
CONTINUE PRESENT DISPLAY
S13
AUX. WINDING LOAD FACTOR LESS THAN X% ?
S14
YES
CONTINUE PRESENT DISPLAY
S15
NO
MAIN HOIST DISPLAYED ?
S16
NO
YES
SWITCH DISPLAY INTO SIMULTANEOUS HOIST
S18
CONTINUE PRESENT DISPLAY
S17
RETURN

| FIG. 5A | FIG. 5B |
|---|---|

LOAD MOMENT INDICATOR OF CRANE

BACKGROUND OF THE INVENTION

1. Field of the Invention

The present invention relates to a load moment indicator of a crane provided with a suspension means.

2. Description of the Related Art

A conventional art will be described taking a crane with an auxiliary sheave shown in FIG. 6 as an example.

In the figure, reference numeral 1 designates a self-traveling type (in the figure, a crawler traveling type is shown) crane body 1. A boom 2 is mounted on the crane body 1 to so as to be hoisted and lowered. An auxiliary sheave bracket 4 with an auxiliary sheave 3 is mounted, as an auxiliary suspending arm, at the extreme end of the boom 2.

On the crane body 1 are mounted a boom raising and lowering winch 5, a main winch 6 and an auxiliary winch 7. The boom 2 is driven to be hoisted and lowered by the boom raising and lowering winch 5 through a boom reeving rope 8 and a boom guyline 9.

A main hoist rope 10 drawn out of the main winch 6 is suspended from the extreme end of the boom to suspend a main hook 11 suspended by many ropes. By the main hoist means constituted as described above, the main winding and hoisting work for raising and lowering mainly a very heavy cargo at a low speed takes place.

On the other hand, an auxiliary hoist rope 12 drawn out of the auxiliary winch 7 is suspended from the auxiliary sheave bracket 4 to suspend an auxiliary hook 13 permanently. By the auxiliary hoist means constituted as described above, the auxiliary winding and suspending work for raising and lowering mainly a light cargo at a high speed takes place.

The main winding and suspending work and the auxiliary winding and suspending work are sometimes carried out simultaneously.

The overload preventive method of a crane provided with two kinds of suspension means of the main side and the auxiliary side as described above is disclosed, for example, in Japanese Patent Application Laid-Open No. Hei 11-246178 Publication. The tension of both the main and auxiliary hoist ropes 10 and 12 and the tension of the boom guyline 9 are respectively detected by a detector to calculate a main hoist load, an auxiliary hoist load, and the whole hoist load. Subsequently, when the hoist loads, and at least one of load factors obtained from the rated loads preset reach a fixed value, an automatic stop valve is operated to automatically stop the crane operation.

The rated load termed herein is the maximum hoist load obtained on the basis of the stability of a crane and the strength of constitutional members (normally, the rupture strength of a rope), which load is calculated for every work radius in advance and stored in a memory.

Even where the auxiliary sheave bracket 4 is replaced with the auxiliary sheave 3 as the auxiliary suspending arm, a jib which is longer than the former is mounted to be raised and lowered or at a fixed angle, or where both the auxiliary sheave bracket 4 and the jib are mounted, and the suspending work is carried out by three suspension means of the main side and the two auxiliary sides, the overload preventive method is basically the same as that described above.

Where the suspending work is carried out simultaneously by both the main side and the auxiliary side, the load value capable of being suspended by each side of ought to be varied in view of the load suspended by the other side. Despite this, the respective rated load is set as a fixed value without taking the other side into consideration, and therefore an operator cannot grasp the actual maximum weight to be suspended, resulting in an obstacle to effective work.

SUMMARY OF THE INVENTION

It is an object of the present invention to provide a load moment indicator of a crane making the most of the suspending ability of a main side and an auxiliary side at the maximum and capable of permitting an operator to clearly grasp the tolerance of the hoist load.

The load moment indicator of a crane according to the present invention comprises:

1) a first hoist means for carrying out a first suspending work, the first hoist means having a first winch, a first rope drawn out of the first winch and suspended from the extreme end of a boom, and a first hook suspended by the first rope;

2) a second hoist means for carrying out a second suspending work, the second hoist means having a second winch, a second rope drawn out of the second winch and suspended from a suspending arm, and a second hook suspended by the second rope; and 4) a calculator as a calculating means for carrying out processing of preventing an overload on the basis of first and second hoist loads carried by the first and second hoist means, and for calculating rated loads determined separately by the first and second hoist means, respectively, the rated load being obtained by reducing one hoist load out of said first and second hoist by a value related to the other of the first and second hoist loads.

In the case of the aforementioned crane shown in FIG. 6, the first hoist means corresponds to a main hoist means. With respect to other constitutions, the corresponding relationship will be described below. The first winch, the first rope, and the first hook correspond to a main winch, a main hoist rope, and a main hook, respectively. Similarly, the second hoist means, the second winch, the suspending arm, the second rope correspond to an auxiliary hoist means, an auxiliary winch, an auxiliary suspending arm, an auxiliary hoist rope, and an auxiliary hook, respectively.

Further, it is preferred that the rated loads be constituted by the following:

(a) a reference value of the first hoist means is set on the basis of a given reference value determined from a view of safety including the stability of a crane and the rupture strength of the rope, and (b) a hoist load of the second hoist means is converted into a load component of the first hoist means to thereby calculate a conversion value, the conversion value being subtracted from the reference value of the first hoist means.

While a case is given in which the hoist load of the second hoist means is converted into the load component of the first hoist means, the reverse thereto will suffice also. In short, the way of thinking for obtaining the rated load is as follows:

(a) a reference value of one side is set, in advance, on the basis of a given base determined from a view of safety of the stability of a crane, the rupture strength of a rope, etc., and (b) a hoist load of the hoist means in other sides is converted into a load component of the one side on the basis of a base of the one side, and the converted value is subtracted from a reference value of the one side.

According to the above-described device, the rated load of the one side can be varied according to the hoist load of other sides. Therefore, the maximum hoist load that can be suspended by both systems, irrespective of the single hoisting work time and the simultaneous hoisting work time of both systems, can be determined as the rated load.

Accordingly, it is possible to make the most of the suspending ability of both the systems and for an operator to clearly grasp how much can be suspended.

Where the reference values of both the main side and auxiliary side are set on the basis of the same base (for example, the crane stability), in both the systems, the suspending weight of other sides may be taken (subtracted) as the load component of the one side on the basis of a base of the one side to thereby obtain the rated load.

BRIEF DESCRIPTION OF THE DRAWINGS

FIGS. 3A to 3C respectively show the displayed contents of a display section of the device, FIGS. 3A, 3B and 3C showing the displayed contents of main winding and hoisting work time, auxiliary winding and hoisting work time, and simultaneous hoisting work time, respectively;

FIG. 4 is a flow chart for explaining the switching operation of the displayed contents by the device;

DESCRIPTION OF THE PREFERRED EMBODIMENTS

The preferred embodiments of the present invention will be described hereinafter with reference to FIGS. 1 to 5.

Figure 1:
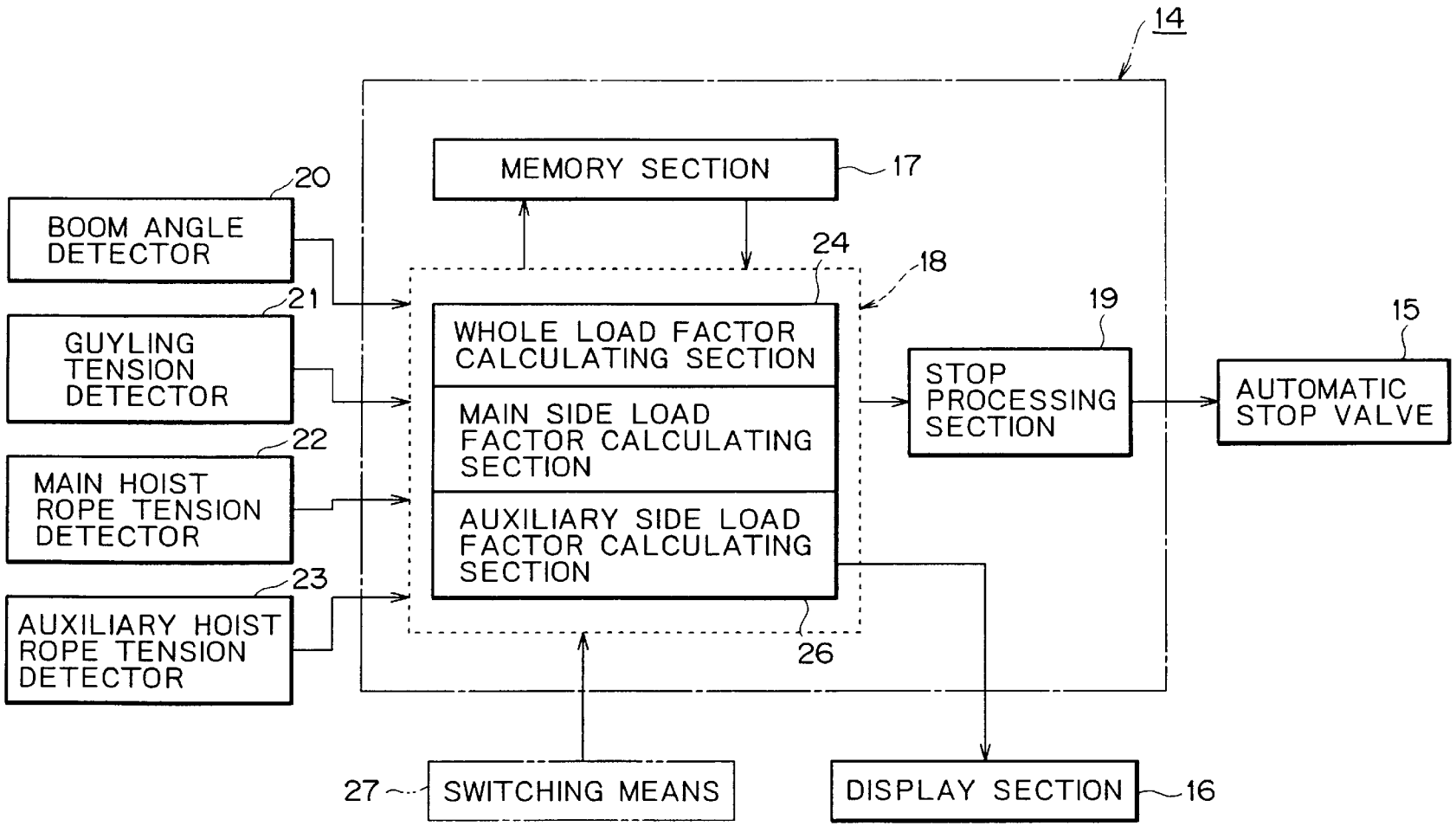
FIG. 1 is a block constitutional view of an load moment indicator according an embodiment of the present invention.

As shown in FIG. 1, the present load moment indicator is constituted by a calculation processing section 14 as a calculation means, an automatic stop valve (a solenoid valve) 15, a display section 16, and a group of detectors 20 to 23.

The calculation processing section 14 comprises a memory section 17, a load factor calculation section 18, and a stop processing section 19. Respective detectors 20 to 23 are provided; i.e., a boom angle detector 20 for detecting a boom angle, a guyline tension detector 21 as a whole hoist load detecting means for detecting a tension (whole hoist load) of the boom guyline 9 shown in FIG.6, a main hoist rope tension detector 22 as a main winding hoist load detecting means for detecting a tension (main side hoist load) of the main hoist rope 10, and a auxiliary hoist rope tension detector 23 as a auxiliary winding hoist load detecting means for detecting a tension (auxiliary side hoist load) of the auxiliary hoist rope 12. Detection values obtained by each of detectors 20 to 23 are input to the load factor calculation section 18.

The load factor calculation section 18 comprises a whole load factor calculation section 24, a main side load factor calculation section 25, and an auxiliary side load factor calculation section 26. The load factors (=hoist load/rated load) relative to the whole, main side and auxiliary side are calculated by these calculation sections 24, 25 and 26. When the load factor reaches a preset value, an overload is judged by the stop processing section 19, a stop signal is then sent to the automatic stop valve (solenoid valve) 15, and the crane operation automatically stops.

Figure 2:
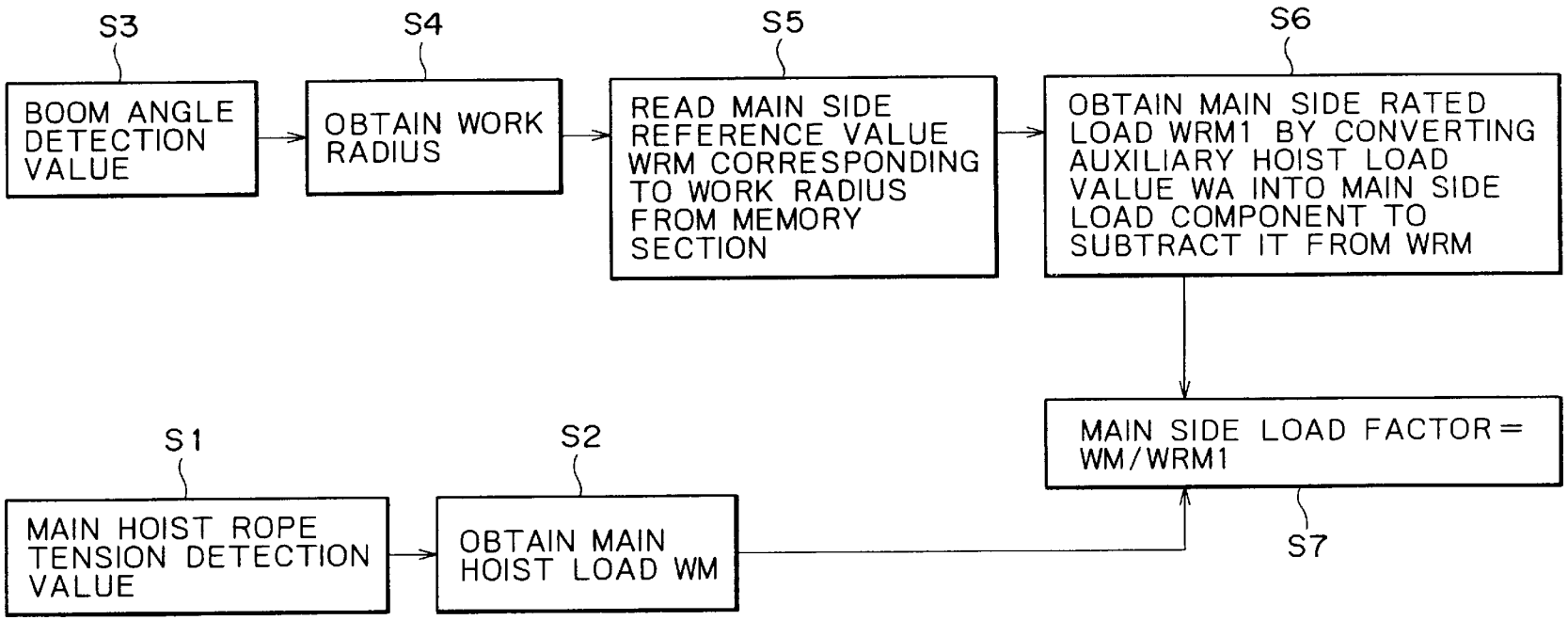
FIG. 2 is a view for explaining the processing contents of a main side load factor calculating section in a calculation processing section of the device.

The processing contents of the load factor calculation section 18 will be described in detail with reference to FIGS. 1 and 2.

First, a main side hoist load WM is obtained from a detected value of a main hoist rope tension by the main hoist rope tension detector 22 (Steps S1, S2).

On the other hand, the work radius is obtained from the present boom angle detected by the boom angle detector 20 (Steps S3, S4). A reference value WRM of the rated load stored in advance for every work radius in the memory section 17 is read from the work radius (Step S5).

The reference value WRM is set as the maximum load value that can be suspended singly by the main winding drum with a fixed stability, with a stability (lowering-down prevention) of a crane as a base.

Next, in the auxiliary side load factor calculation section 26, an auxiliary side hoist load value WA obtained on the basis of the detected value from the auxiliary hoist rope tension detector 23 is converted into a load component of the main side. The converted value from the reference value WRM of the main side is subtracted to calculate a rated load value WRM1 which is a load value capable of being suspended singly by the main side with the stability at present (Step S6).

The present load factor is then obtained from the rated load value WRM obtained in Step S6 and the main side hoist load value WM (Step S7). When the load factor reaches a fixed value, a stop signal is sent to the automatic stop valve 15 through the stop processing section 19 as described previously.

Now, the processing of the Step S6, which is one of characteristics of the load moment indicator, will be described in more detail.

Figure 6:
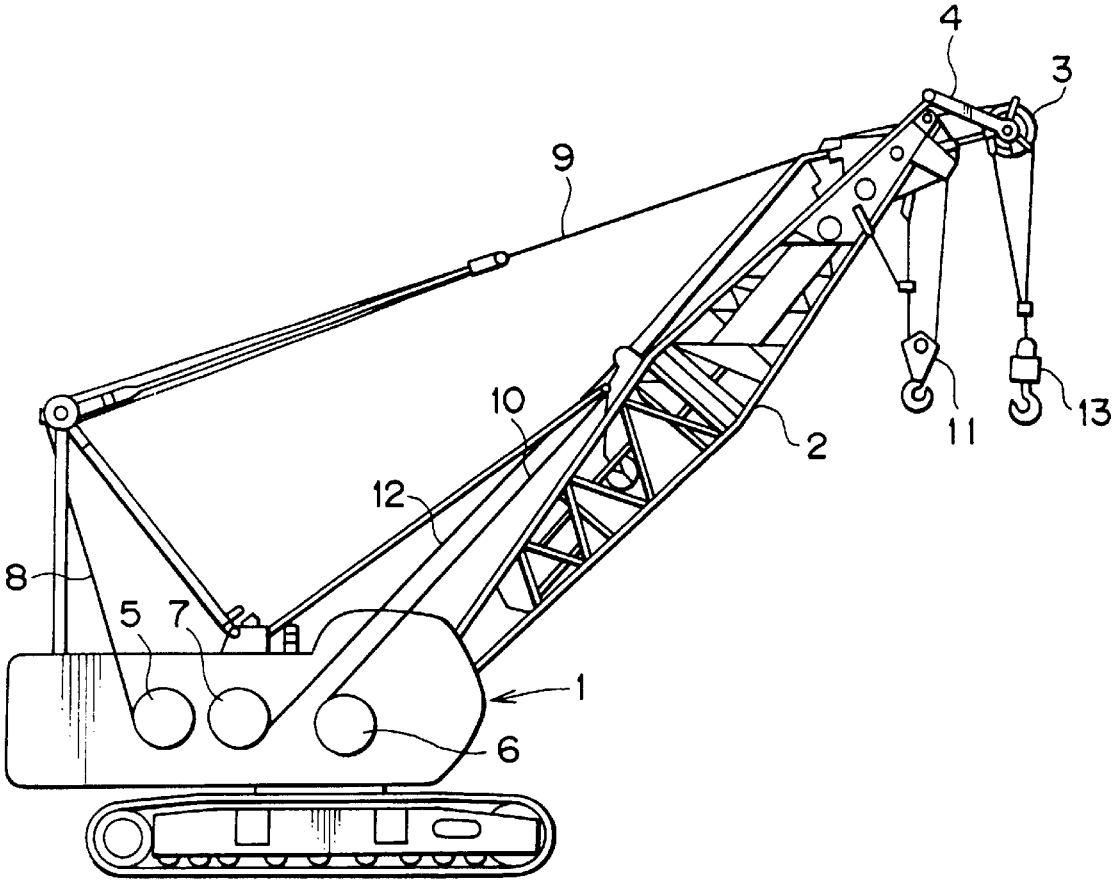
FIG. 6 PRIOR ART
FIG. 6 is a schematic side view of a crane to which the present invention is applied.

In the crane with an auxiliary sheave bracket 4 shown in FIG. 6, generally, the main hook 11 side is in the form of multi-suspension, and the auxiliary hook 13 side is in the form of permanent suspension.

In this case, the rated load of the main side is usually determined on the basis of the stability of a crane since there is a high possibility that the collapse of the crane occurs prior to the rupture of the main hoist rope 10. On the other hand, since the auxiliary side employs a single suspension so that the rupture of the auxiliary hoist rope 12 comes into question, the rated load is determined on the basis of the rope rupture strength.

It is now supposed that the rated load value of the main side at a work radius is 40*t* determined from the stability of a crane, and the rated load value of the auxiliary side is 10*t* determined from the rupture strength of a rope.

The state that 40*t* is suspended in the main side under the above-described conditions is contemplated. Already reaching the rated load value of the main side (no tolerance of the stability), no load can be suspended in the auxiliary side. If suspended, the collapse of the crane likely occurs.

Conversely, the state that 10*t* is suspended in the auxiliary side is contemplated. Even if, in the auxiliary side, no more load can be suspended, there is no problem with respect to the stability in the main side. Therefore, additional loads can still be suspended.

For example, if there is a tolerance of suspending a load of 20*t* in the main side, a relationship of (c) in Table 1 below is obtained.

TABLE 1

| | main side reference value | aux. side reference value |
|---|---|---|
| a main winding single hoisting work | 40t | — |
| b aux. winding single hoisting work | — | 10t |
| c main winding simultaneous work | 40~20t | 0~10t |

That is, where the hoisting work is carried out singly in the main side and the auxiliary side, respectively, a cargo of 40*t* and a cargo of 10*t* can be suspended in the main winding and auxiliary winding, respectively, as shown in (a) and (b) of Table 1. Where cargoes are suspended simultaneously in the main side and the auxiliary side, a load that can be suspended in the main side gradually reduces from 40*t* to 20*t* as the cargo in the auxiliary side increase from 0*t* to 10*t*. Conversely, where the hoist load in the main side is not more than 20*t*, 10*t* at the maximum can be suspended in the auxiliary side. The load that can be suspended in the auxiliary side gradually reduces from 10*t* to 0*t* as the hoist load in the main side increases from 20*t* to 40*t*.

So, in the load moment indicator, the calculation processing is carried out according to the following:

$$WRM\ 1 = \text{Reference value}\ WRM - (\delta A/\delta M) \times WA \quad (1)$$

WRM1: Actual rated load value in the main side

δA: Increase coefficient of a guyline tension when a unit load is applied to an auxiliary hook δM: Increase coefficient of a guyline tension when a unit load is applied to a main hook WA: Suspended load value in an auxiliary side δM and δA are stored in advance in the memory 17. Table 1 shows the case of δA:

δM=2:1.

WRM is a reference value of the rated load that can be suspended in the case of the main side single stored in the memory 17. The value obtained by converting the hoist load value WA in the auxiliary side into the load component on the main side is subtracted to obtain the rated load value WRM in the main side that can be suspended actually in consideration of the present auxiliary side load value. In the case of the hoist load value WA=0 in the auxiliary side, WRM1=WRM results.

By doing so, in case of the aforementioned example, a cargo of 20*t* can be suspended in the main side in the state that only 10*t* is suspended in the auxiliary side. Accordingly, the suspending ability peculiar to the crane can be used to the maximum.

However, when the reference values of both the systems are set on the basis of different bases, there occurs a case that the above-described way cannot hold. For example, there can be mentioned a case where a reference value of the main side is set on the basis of the stability, and in the auxiliary side, a reference value is set to a far lower value than the case of the stability on the basis of the rope rupture strength in the auxiliary side. When the above-described way is employed to obtain the rated total value in the auxiliary side, and the hoist load in the main side is converted into the load component in the auxiliary side, a very great value results. As a result, the converted value exceeds the reference value in the auxiliary side, and the rated load becomes negative despite the fact that a load can be still suspended in terms of the stability.

In such a case as described, a tolerant load of the other side (in the above example, the main side) is converted into a load component in the one side (the auxiliary system) on the basis of a base (the crane stability) of a reference value in the other side (same as above). This converted value is compared with the reference value of own side (auxiliary system) to select the lower value as the rated load, thereby enabling to make the most of the suspending ability of both the systems at the maximum.

In the following, the above point will be described in detail referring to Equation (1) given above.

Taking the auxiliary system into consideration, where both the main side and the auxiliary side have the ability obtained from the stability, the rated load value WRA1 of the auxiliary winding is obtained similarly to the main winding. However, where they have the ability obtained by the rupture strength of a rope as a base, when it is obtained from Equation (1) similarly to the main side, there is a problem. The value obtained by converting the hoist load of the main side into the load component of the auxiliary side becomes very great, so that the converted value exceeds the reference value WRA of the rated load in the auxiliary side. Because of this, the rated load to be calculated becomes negative despite the fact that a load can be further suspended in terms of stability.

So, in the auxiliary side, such as Equation (2), a tolerant load (a load that can be still suspended in the main side) part of the main side is converted into the load component WRA1 of the auxiliary side (a load value that can be suspended in the auxiliary side with respect to the main side load in terms of the stability) on the basis of the stability of a crane which is a base of the rated load in the main side. Then, comparing it with the reference value WRA in the auxiliary side determined from the rope rupture strength, smaller one is taken as a rated load WRA2 in the auxiliary side for which the hoist load in the main side is taken into consideration.

$$WRA1 = (\delta M/\delta A) \times (WRM - WM) \quad (2)$$

WRA1 WRA WRA2=WRA1

WRA1>WRA WRA2=WRA

WM:Suspended load value of the main side

WRA: Reference value of the rated load in the auxiliary side determined by the work radius or the like (10*t* in the previous example).

In accordance with the above-described processing, with respect to both the main side and the auxiliary side, a load that can be suspended at present taking the hoist load in the other side into consideration is determined as a rated load. With this, there can make the most of the suspending ability of both the systems at the maximum.

Incidentally, as a calculation method for obtaining the above load (including the load factor), the first calculation method is normally used which uses detected values obtained by three tension detectors 21, 22, and 23 as described above. However, it is constituted so that where an abnormal condition should occur in one of these detectors, the method is switched automatically to a second calculation method in which the abnormal condition is judged by a signal of a detector (for example, it can be judged by the lowering of an output voltage of a detector), and the load is computed on the basis of detected values obtained by the remaining two detectors.

a) Where an abnormal condition occurs in the guyline tension detector 21:

From the hoist loads WM and WA of the main side and the auxiliary side detected by both the rope tension detectors 22 and 23 of the main winding and the auxiliary winding, the whole hoist load WO is obtained by WO=WM+WA.

b) Where an abnormal condition occurs in the rope tension detector 22 of the main winding:

From the whole hoist load WO detected by the guyline tension detector 21 and the hoist load WA of the auxiliary system detected by the rope tension detector 23 of the auxiliary winding, the hoist load WM of the main side is obtained by WM=WO−WA.

c) Where an abnormal condition occurs in the rope tension detector 23 of the auxiliary winding:

Similarly to the case of the above b), from the detected whole hoist load WO and the hoist load WM of the main winding, the hoist load WA of the auxiliary winding is obtained by WA=WO−WM.

Thus, even if the abnormal condition occurs in one of the detectors 21, 22, and 23, the method is automatically switched to the calculation method corresponding thereto, thus enabling execution of the load computation without any trouble.

Accordingly, there is no possibility that workability lowers as in the case where the overload state is left because the load computation cannot be made due to the abnormality of detectors, and the operation of a crane is stopped due to the occurrence of the abnormality of detectors.

Alternatively, when the abnormal condition occurs in the detectors, that effect may be displayed on the display section 16 for an operator.

There is a further case where one of three detectors 21, 22, and 23 becomes disabled for detection due to the work conditions (such as a difference in crane work and clamshell work, or a difference in the way of stretching a rope with respect to a hook), or a case where one of the detectors is not used intentionally for the reason such as reduction in display (or calculation) errors.

In order to cope with such a case as described, the switching means 27 may be provided as indicated by the dash-dotted contour lines in FIG. 1 so as to switch the calculation method between the first calculation method and the second calculation method.

In summary, according to the present invention, where an abnormal condition occurs in one out of the main winding suspension load detecting means, the auxiliary suspension load detecting means, and the whole suspension load detecting means, or where one out of them is not used intentionally due to re-mounting of an attachment or a change in number of stretching ropes, the load calculation is carried out on the basis of the detected values of the remaining two detecting means. Therefore, the load calculation is carried out without any trouble according to the work conditions including abnormality of detection. Particularly, when one detecting means is abnormal, the calculation section judges this abnormality to automatically switch the calculation methods. Therefore, no erroneous calculation caused by the forgetting of switching or a switching mistake occurs.

The display operation accomplished by the calculation processing section 14 and the display section 16 will be explained hereinafter.

The work in the crane work includes three kinds of work; i.e., the main winding hoisting work by the main hoist means, the auxiliary winding hoisting work by the auxiliary hoist means, and the simultaneous hoisting work for carrying them out simultaneously.

A signal representative of the kinds of these work, and a work-state signal such as a signal in connection with the present load and load factor are output from the calculation processing section 14 (load factor calculation section 18) to the display section 16. The kind of work being now carried out and the contents of the work are displayed by the display section 16 along with other necessary data on the basis of the aforementioned signals.

Figure 3A:
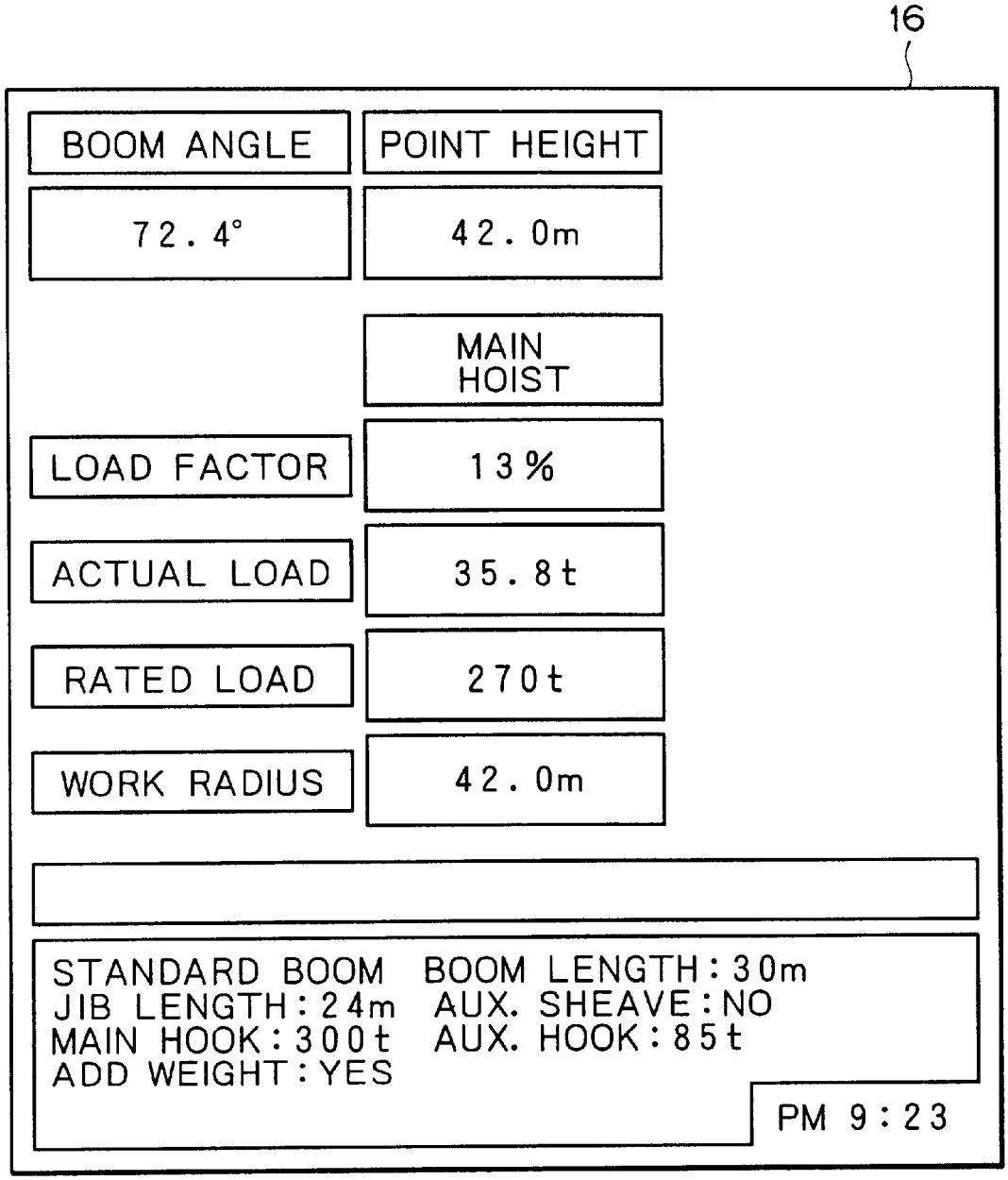
Figure 3B:
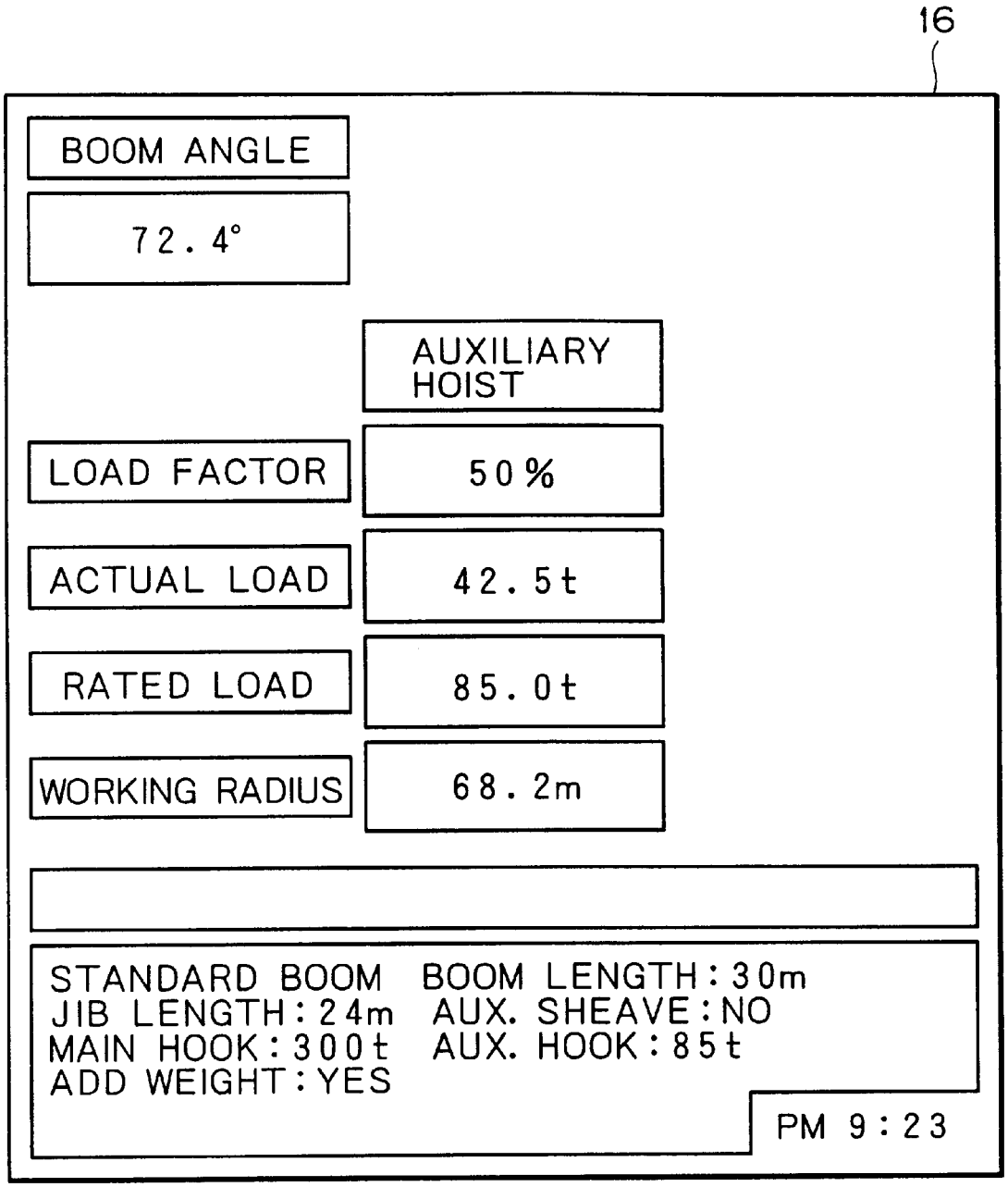

One example of the displayed contents is shown in FIGS. 3A to 3C.

FIGS. 3A, 3B, and 3C show the displayed contents of the main winding hoisting work time, the auxiliary hoisting work time, and the simultaneous hoisting work time, respectively. Characters "main hoist", "auxiliary hoist", and "simultaneous hoist" which show the main winding, auxiliary winding, and simultaneous winding, respectively, are displayed on a monitor screen. In the case of the simultaneous hoisting work time, both "main hoist" and "auxiliary hoist" which mean "simultaneous hoist" are displayed (FIG. 3C). Of course, "simultaneous hoist" may be displayed. For the sake of convenience, in any case, the display of "simultaneous hoist" is called hereinafter.

In three display patterns, the work contents of the load factor, actual load, rated load, and work radius are displayed in numerical value. As the others, work data such as boom angle, jib angle, point height (height of a boom point) and so on are displayed in numerical value.

The calculation processing section 14 automatically switches the display of work state by the display section 16 on the basis of a detector signal.

This will be described with reference to FIG. 4. Here, the processing for judging abnormality of a detector to switch the calculation method as described above is also shown.

As the processing starts, a detector signal is input (Step S1). Judgment is made whether or not the tension detectors 21, 22, and 23 for the guyline, main hoist rope, and auxiliary hoist rope are normal (abnormal) on the basis of the detector signal (Step S2).

Where normality is judged, the main winding suspension load (in the drawing, the main actual load is described), and the auxiliary suspension load (also, in the drawing, the auxiliary actual load) are calculated by the first calculation method (Steps S3 and S4).

Where abnormality is judged, the main winding suspension load and the auxiliary suspension load are calculated by the second calculation method (Steps S5 and S6).

Then, in Steps S7 and S8, both load factors for the main winding and the auxiliary winding are obtained on the basis of both suspension loads for the main winding and auxiliary winding. Subsequently, in Step S9, judgment is made whether or not the main winding load factor is less than a value (X%) preset as a numerical value representative of the absence of aload. If NO (main winding load is present) is judged, judgment is made in Step S10, whether or not the present display is "auxiliary hoist". If YES ("auxiliary hoist"), the display is switched to "Simultaneous suspension" in Step 11.

On the other hand, where NO (main winding load is not present) is judged in Step S9, the present display (one of "main hoist", "auxiliary hoist" and "simultaneous hoist") is continued in Step S12. Where judgment is made in Step S10 that the auxiliary winding suspension display is not present ("main hoist" or "simultaneous hoist"), the present display ("main hoist" or "hoist") is continued in Step S13.

Then, in Step S14, judgment is made whether or not the auxiliary winding load factor is less than X (%) similarly to the case of the main winding load factor in Step S9. If judgment is made of YES (auxiliary winding load is not present), the present display (one of "main hoist", "auxiliary hoist" and "simultaneous hoist" is continued in Step S15.

On the other hand, if NO (auxiliary winding load is present) is judged in Step S14, the step proceeds to Step S16, in which judgment is made whether or not the present display is "main hoist". If NO, the present display ("auxiliary hoist" or "simultaneous hoist") is continued in Step 17.

On the other hand, if judgment is made of YES, that is, the main winding suspension is displayed in Step 16, the display is switched to "simultaneous hoist" in Step 18.

In this manner, the display in the display section 16 can be adjusted to the present work state. Therefore, even where the work state is often changed, or where the work continues for a period of time, the work state can be recognized clearly by an operator. Further, the display effect can be improved by pressing the display to a necessary display. Thereby, the safety can be further improved.

Figure 5A:
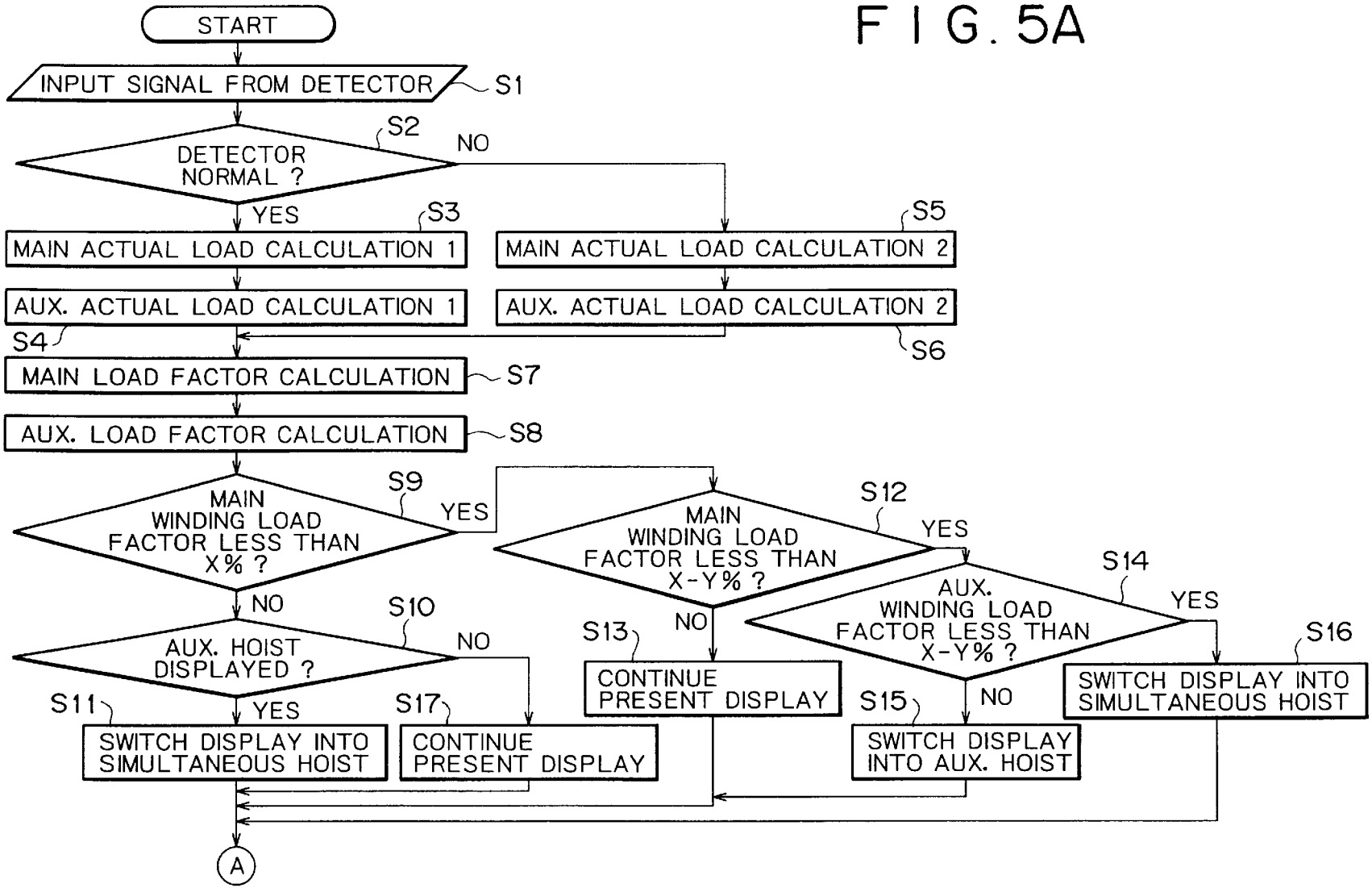
FIG. 5 is a flow chart in which a part of the FIG. 4 flow is suspended.
Figures 5, 5B:
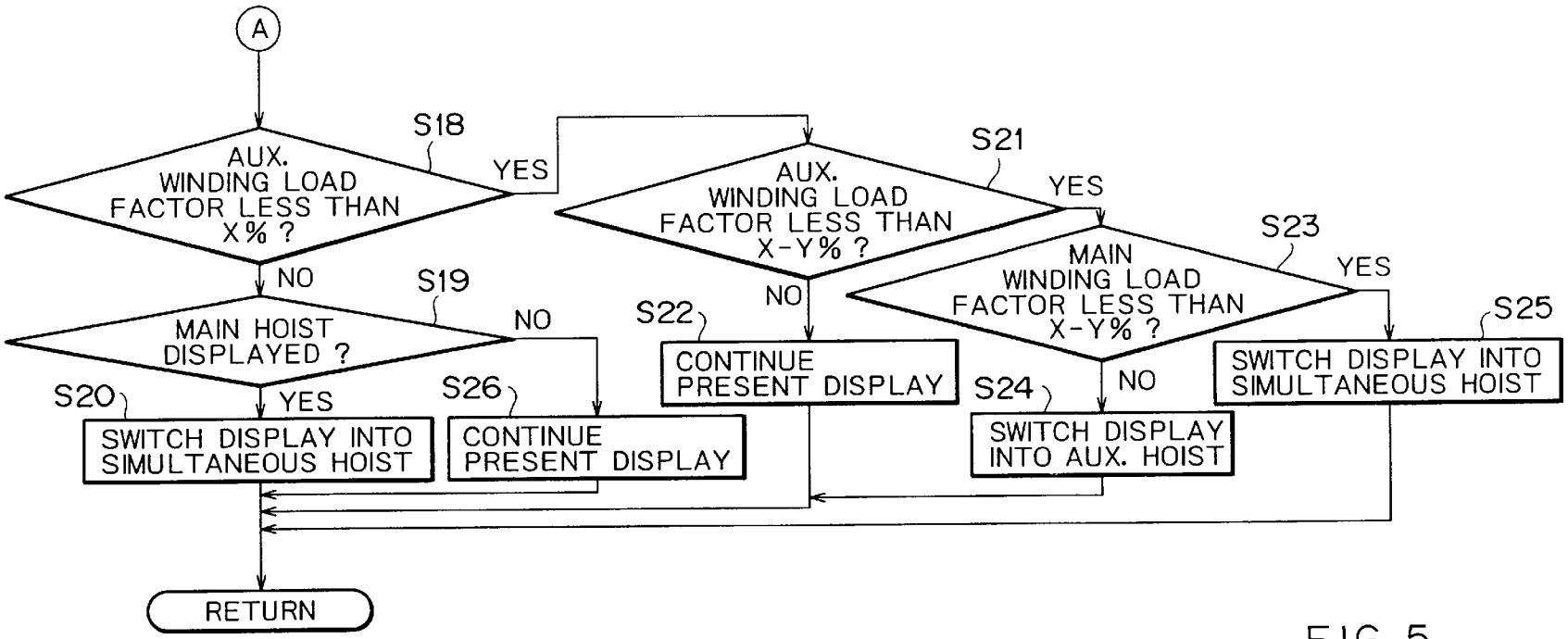

FIG. 5 shows a partial modification of the flow shown in FIG. 4.

In the flow of FIG. 4, as the threshold of judgment of presence or absence (display switching) of the main winding load or auxiliary winding load, "Less than X%" was set with respect to the main winding load factor and auxiliary winding load factor in Steps S9 and S14. If doing so alone, there is a possibility of returning to the original display at X%, and therefore, the display is not likely stabilized.

The flow of FIG. 5 employs a constitution of returning to the original display at X-Y% (clearly smaller value than X) in order to stabilize the display with a moderate hysteresis.

Step S1 to Step S11 employ the same procedure as the case of FIG. 4; in Step S9, if YES (the main winding load factor is less than X%), whether or not the main winding load factor is X-Y% is further judged in Step S12. If NO, the present display is continued (Step S13), and if YES (clearly smaller than X), whether or not the auxiliary load factor is X-Y% is judged in Step S14.

If NO (auxiliary winding load is present), the display is switched to "auxiliary hoist" in Step S15. If YES (auxiliary winding load is not present), the display is switched to "simultaneous hoist" in Step S16. If NO in Step S10, the present display is continued in Step S17.

Then, the display is selected in the procedure of Step S18 to Step S26 similarly to the step S9 to Step S17.

It is noted that in the flow charts of FIGS. 4 and 5, where the main winding suspension state was judged in the state that "auxiliary hoist" is displayed, the display is switched to "simultaneous hoist" in Step S11. However, at that time, the display may be switched to "main hoist". Further, similarly, where the auxiliary hoist state was judged in the state that "main hoist" is displayed (Step S14 in FIG. 4 and Step S20 in FIG. 5), the display may be switched to "auxiliary hoist". In this manner, the main winding suspension and the auxiliary hoist may be sequentially switched to display the simultaneous hoist state.

In summary, according to the present invention, the kind of work being carried out at present and the work contents can be displayed from the main hoisting work, auxiliary hoisting work, and simultaneous hoisting work. Therefore, even where the work state is often changed, or where the work continues for a long period of time, the present work state can be recognized clearly by an operator. Further, the display effect can be improved by pressing the display to a necessary display. Thereby, the safety can be further improved.

An improvement and modification within the range not departing the technical idea of the present invention belong to the technical scope of the present invention. Other embodiments can be given below.

(1) In the above-described embodiment, the most general case has been described in which the reference value of the rated load is determined with the crane stability in the main side and the rope rupture strength in the auxiliary system as bases. In the case of a crane in which both the reference values are determined with the same base, the rated load can be obtained by the Equation (1) or Equation (2).

(2) Alternatively, in connection with the display contents in the display section 16, the remaining hoist loads (rated load-actual hoist load) and the remaining work radius (work radius of load factor 100%—present work radius) with respect to the main winding and auxiliary hoist loads may be displayed together with the present hoist load and the work radius.

By doing so, an operator is able to clearly grasp how much more can be suspended, and how much (meter) the work radius can be extended with respect to both the main side and the auxiliary side. Because of this, safety can be further enhanced while making the most of maximum suspension ability.

(3) During simultaneous hoisting of the main winding and auxiliary winding, the construction (mainly, a boom) receives a greater stress than the main winding single hoist. Therefore, at the simultaneous hoist time, in calculating the main winding rated load, the reduction coefficient may be multiplied according to the load factor of the auxiliary winding load. By doing so, if the load factor of the auxiliary winding load increases, damage to the boom can be suppressed by lowering the main winding rated load.

(4) In the above-described embodiment, an example was employed with respect to a crane provided with an auxiliary sheave bracket with an auxiliary sheave as an auxiliary hoist arm. However, the present invention can be also applied to a crane provided at the extreme end of a boom with a raising and lowering or fixed type jib as an auxiliary hoist arm. In the case of the crane using a jib, a reference value of an auxiliary side is determined according to the length of a boom and a jib, the work radius and so on.

Further, the present invention can be applied to not only the lattice boom type crane illustrated in the above embodiments, but also a crane using a box-shaped expansion boom (in which case, the length of a boom is changed, whereby the work radius is changed).

FIG. 1

15 AUTOMATIC STOP VALVE
16 DISPLAY SECTION
17 MEMORY SECTION
19 TOP PROCESSING SECTION
20 BOOM ANGLE DETECTOR
21 GUYLINE TENSION DETECTOR
22 MAIN HOIST ROPE TENSION DETECTOR
23 AUXILIARY HOIST ROPE TENSION DETECTOR
24 WHOLE LOAD FACTOR CALCULATING SECTION
25 MAIN SIDE LOAD FACTOR CALCULATING SECTION
26 AUXILIARY SIDE LOAD FACTOR CALCULATING SECTION
27 SWITCHING MEANS

FIG. 2

S1 MAIN HOIST ROPE TENSION DETECTION VALUE
S2 OBTAIN MAIN HOIST LOAD WM
S3 BOOM ANGLE DETECTION VALUE
S4 OBTAIN WORK RADIUS

S5 READ MAIN SIDE REFERENCE VALUE WRM CORRESPONDING TO WORK RADIUS FROM MEMORY SECTION
S6 OBTAIN MAIN SIDE RATED LOAD WRM1 BY CONVERTING AUXILIARY HOIST LOAD VALUE WA INTO MAIN SIDE LOAD COMPONENT TO SUBTRACT IT FROM WRM
S7 MAIN SIDE LOAD FACTOR=WM/WRM1
FIG. 3A
BOOM ANGLE POINT HEIGHT
MAIN HOIST
LOAD FACTOR
ACTUAL LOAD
RATED LOAD
WORK RADIUS
STANDARD BOOM BOOM LENGTH: JIB LENGTH:
AUX.SHEAVE:NO MAIN HOOK: AUX. HOOK:
ADD WEIGHT:YES
FIG. 3B
BOOM ANGLE
AUX. HOIST
LOAD FACTOR
ACTUAL LOAD
RATED LOAD
WORK RADIUS
STANDARD BOOM BOOM LENGTH: JIB LENGTH:
AUX.SHEAVE:NO MAIN HOOK: AUX. HOOK:
ADD WEIGHT:YES
FIG. 3C
BOOM ANGLE JIB ANGLE POINT HEIGHT
MAIN HOIST AUX. HOIST
LOAD FACTOR
ACTUAL LOAD
RATED LOAD
WORK RADIUS
LOAD FACTOR EXCEEDS 100%
STANDARD BOOM BOOM LENGTH: JIB LENGTH:
AUX.SHEAVE:NO MAIN HOOK: AUX.HOOK:
ADD WEIGHT:YES
FIG. 4
START
S1 INPUT SIGNAL FROM DETECTOR
S2 DETECTOR NORMAL?
S3 MAIN ACTUAL LOAD CALCULATION
S4 AUX. ACTUAL LOAD CALCULATION 1
S5 MAIN ACTUAL LOAD CALCULATION 2
S6 AUX. ACTUAL LOAD CALCULATION 2
S7 MAIN LOAD FACTOR CALCULATION
S8 AUX. LOAD FACTOR CALCULATION
S9 MAIN WINDING LOAD FACTOR LESS THAN X%?
S10 AUX. HOIST DISPLAYED?
S11 SWITCH DISPLAY INTO SIMULTANEOUS HOIST
S12 CONTINUE PRESENT DISPLAY
S13 CONTINUE PRESENT DISPLAY
S14 AUX. WINDING LOAD FACTOR LESS THAN X%?
S15 CONTINUE PRESENT DISPLAY
S16 MAIN HOIST DISPLAYED?
S17 CONTINUE PRESENT DISPLAY
S18 SWITCH DISPLAY INTO SIMULTANEOUS HOIST
RETURN
FIG. 5
START
S1 INPUT SIGNAL FROM DETECTOR
S2 DETECTOR NORMAL?
S3 MAIN ACTUAL LOAD CALCULATION 1
S4 AUX. ACTUAL LOAD CALCULATION 1
S5 MAIN ACTUAL LOAD CALCULATION 2
S6 AUX. ACTUAL LOAD CALCULATION 2
S7 MAIN LOAD FACTOR CALCULATION
S8 AUX. LOAD FACTOR CALCULATION
S9 MAIN WINDING LOAD FACTOR LESS THAN X%?
S10 AUX. HOIST DISPLAYED?
S11 SWITCH DISPLAY INTO SIMULTANEOUS HOIST
S12 MAIN WINDING LOAD FACTOR LESS THAN X-Y%?
S13 CONTINUE PRESENT DISPLAY
S14 AUX. WINDING LOAD FACTOR LESS THAN X-Y%?
S15 SWITCH DISPLAY INTO AUX. HOIST
S16 SWITCH DISPLAY INTO SIMULTANEOUS HOIST
S17 CONTINUE PRESENT DISPLAY
S18 AUX. WINDING LOAD FACTOR LESS THAN X%?
S19 MAIN HOIST DISPLAYED?
S20 SWITCH DISPLAY INTO SIMULTANEOUS HOIST
S21 AUX. WINDING LOAD FACTOR LESS THAN X-Y%?
S22 CONTINUE PRESENT DISPLAY
S23 MAIN WINDING LOAD FACTOR LESS THAN X-Y%?
S24 SWITCH DISPLAY INTO MAIN WINDING HOIST
S25 SWITCH DISPLAY INTO SIMULTANEOUS HOIST
S26 CONTINUE PRESENT DISPLAY
RETURN

We claim:

1. An load moment indicator of a crane comprising:

a boom having a hoist arm provided at an extreme end;

a first hoist means for carrying out a first hoisting work, said first hoist means having a first winch, a first rope drawn out of said first winch and suspended from the extreme end of said boom, and a first hook suspended by said first rope;

a second hoist means for carrying out a second hoisting work, said second hoist means having a second winch, a second rope drawn out of said second winch and suspended from said hoist arm, and a second hook suspended by said second rope; and a calculator for carrying out processing of preventing an overload on the basis of first and second hoist loads carried by said first and second hoist means, and for calculating a rated load for said first and second hoist means, said rated load being obtained by modifying one hoist load out of said first and second hoist loads by an amount related to the other of said first and second hoist loads.

2. The load moment indicator according to claim 1, wherein said calculator obtains said rated load by the following (a) and (b):

(a) a reference value of said first hoist means is set on the basis of a given reference value including the stability of a crane and the rupture strength of said rope, and (b) a hoist load of said second hoist means is converted into a load component of said first hoist means to thereby calculate a conversion value, said conversion value being subtracted from said reference value of said first hoist means.

3. The load moment indicator according to claim 1, wherein said calculator calculates a converted value by converting a tolerant load that can be suspended by said second hoist means into a load component of said first hoist means on the basis of a reference value of said second hoist means, and said conversion value is compared with said reference value to select a lower value whereby a rated load of said first hoist means is obtained.

4. The load moment indicator according to claim 1, wherein said calculator obtains said rated load by the following (a) and (b):

(a) in said first hoist means, a reference value of said first hoist means is preset with the stability of a crane as a base, a hoist load of said second hoist means is converted into said first hoist load component with the stability of a crane as a base to thereby calculate a converted value, and said converted value is subtracted from the reference value of said first hoist means, and (b) in said second hoist means, a reference value of said second hoist means is preset with rupture strength o f said second rope as a base, a tolerant load that can be suspended by said first hoist means is converted into said second hoist load component with the stability of the crane as a base to thereby calculate a converted value, and said converted value is compared with the reference value of said second hoist means to select a lower value.

5. The load moment indicator of a crane according to claim 1, further comprising:

a first hoist load detector for detecting said first hoist load;

a second hoist load detector for detecting said second hoist load; and means for determining a whole hoist load which is the sum of sad first hoist load and said second hoist load.

6. The load moment indicator of a crane according to claim 5, wherein said calculator is capable of switching a load calculation method for obtaining said first hoist load and said second hoist load into any one of the following two calculation methods:

(a) a first calculation method using detected values obtained by said detectors and said means for determining; and (b) a second calculation method using detected values obtained by two out of said detectors and said means for determining.

7. The load moment indicator of a crane according to claim 6, wherein said calculator has a switch for switching the calculation method from said first calculation method into said second calculation method, said switch judging presence or absence of abnormality of the detector on the basis of signals from the respective detector, and if one of them is judged to be abnormal, switching the calculation method from the first calculation method into the second calculation method.

8. The load moment indicator of a crane according to claim 1, further comprising:

a display for displaying a work state, said display displaying a kind of work being carried out at present out of said first hoisting work by said first hoist means, said second hoisting work by said second hoist means, and the simultaneous hoisting work by both said first hoist means and said second hoist means on the basis of said first hoist load and said second hoist load detected, and work contents.

9. An load moment indicator so constituted that main winding and suspending work is carried out by a main hoist means provided with an auxiliary hoist arm at the extreme end of a boom, and having a main winch, a main hoist rope drawn out of said main winch and suspended from the extreme end of said boom, and a main hook suspended by said main hoist rope; auxiliary hoisting work is carried out by an auxiliary hoist means having an auxiliary hoist rope drawn out of said auxiliary winch and suspended from said auxiliary hoist arm, and an auxiliary hook suspended by said auxiliary hoist rope; a main hoist load which is a load of said main hoist means, and an auxiliary hoist load which is a load of said auxiliary hoist means are respectively detected by a load detecting means; and processing for preventing an overload is carried out by a calculating means on the basis of said detected hoist load and a rated load determined separately as a load that can be suspended separately by a main and an auxiliary hoist means, wherein said calculating means obtains the rated load by the following (a) and (b):

(a) a reference value of one side is preset on the basis of a given base determined from a view of safety comprising the stability of the crane and rupture strength of a rope; and (b) a hoist load of the hoist means in the other side is converted into a load component of the one side on the basis of the one side, said converted value being subtracted from the reference value of the one side.

* * * * *